US005659957A

United States Patent [19]

Fujita

[11] Patent Number: 5,659,957

[45] Date of Patent: Aug. 26, 1997

[54] HAIR-CUTTING DEVICE

[76] Inventor: Fumihiro Fujita, I-43, II-chome, 5-jo, Nishioka, Toyohira-ku, Sapporo, Hokkaido, Japan

[21] Appl. No.: 561,328

[22] Filed: Nov. 21, 1995

[30] Foreign Application Priority Data

Nov. 22, 1994 [JP] Japan ..... 6-312524

[51] Int. Cl.[6] ..... B26B 19/18

[52] U.S. Cl. ..... 30/124; 30/206; 30/233.5

[58] Field of Search ..... 30/124, 140, 205, 30/206, 276, 263, 264, 233, 233.5

[56] References Cited

U.S. PATENT DOCUMENTS 3,138,870 6/1964 Stachon ..... 30/206

4,020,549 5/1977 Edwards ..... 30/140

5,309,640 5/1994 Caron ..... 30/140

*Primary Examiner*—Hwei-Siu Payer

*Attorney, Agent, or Firm*—Watson Cole Stevens Davis, P.L.L.C.

[57] ABSTRACT

A hair cutting device has a movable arm for holding a comb and a mechanism for driving the movable comb which combines light weight with hardness. The mechanism to drive the movable arm comprises a bar screw rotated by a drive motor and a ring that ascends or descends, in accordance with the spiral groove of the bar screw. To eliminate hair damage caused by a haircut, high-frequency electricity or minute flame jets from minute holes can be alternatively used for cutting or burning off hairs nipped in the comb.

6 Claims, 6 Drawing Sheets

HAIR-CUTTING DEVICE

FIELD OF THE INVENTION

The invention relates to a hair-cutting device, which is designed to cut hairs to any desired preset length.

PRIOR ART

FIG. 7 illustrates a conventional electric hair cutter (Japanese Patent Application 1991-No. 155892 official bulletin) that is widely known. The hair cutter 1, which is designed to cut hairs evenly to any desired length, comprises the body 2 with a fixed blade 5 and a movable blade 6, and a hair-holding part 3 under the body. By pressing a depression 7 on the top of the body 2, the hair holding part 3 is detached from the body 2 and the said blades are separated open, so that the hairs can be brought into the hair-holding part 3.

The movable blade 6 is driven when the body 2 and the hair holding part 3 are rejoined by gripping. To use such a hair cutter, you are supposed to grip the body 2 and the hair holding part 3 with your thumb placed on the depression 7. Then insert the hairs into the opening (between the separated blades) by pressing the depression 7 as shown in FIG. 8, and then rejoin the body 2 and the hair-holding part 3 to drive the movable blade 6 at the desired hair length, to cut hairs.

Cutting hairs to a desired length evenly, however, is said to be the most difficult hairdressing technique. No matter what you use to cut hairs, scissors or the above hair cutter, the eventual hair style will never look good and will be hard to trim, if the ends of the hairs are eventually not at the desired positions of the head.

FIG. 9 illustrates an fundamental example of the haircut proportion, where each figure shows the length by centimeter. This basic standard proportion has been traditionally followed by the hairdressing industry, even though it may often variegated in accordance with the vogue. The same applies to women's short hairstyle.

Only a limited number of professional hairdressers are capable of actually realizing the ideal proportion, because they rely on their experiences, eye estimation, and their feeling. Therefore, as far as the haircut length depends on eye estimation or experiences, the ideal proportion is very difficult to achieve even for professional hairdressers. Needless to say, a general amateur can hardly be able to perform the same, without any idea about the basic proportion, and with a conventional hair cutter.

Accordingly, the applicant proposes a hair-cutting device that precisely and easily cut hairs to an even length regardless of the user's technique(Japanese Patent Application 1993-89210). As shown in FIG. 10, the hair-cutting device comprises at least the grip 10, where cylindrical guide 11 is attached, a movable arm 12 and a fixed arm 13 protruding from the cylindrical guide, and combs 14 and 15 on the end of the arms respectively. A rotary cutter (not illustrated) is attached on the reverse side of the comb 14 of the movable arm. FIG. 11 shows the drive relations among the above parts.

FIG. 12 illustrates the structure of the hair-cutting device. The movable arm 12 is driven upward by the motor 21 installed in the cylindrical guide 11, to be stopped at any desired position selected by the setting switch 18, where the rotary cutter 19 cuts hairs H. After the rotary cutter 19 is driven to cut hairs R, the movable arm 12 descends automatically to the bottom end of the guide and stops there.

The movable arm 12 is driven by the rotation of the spiral screw 20 installed in the cylindrical guide 11. The spiral screw 20 is driven by the motor 21 installed in the central part that joints and supports the grip 10 and the cylindrical guide 11. The spiral screw 20 rotates with its upper and lower ends supported by the axis 22 and 23, and has pins 24 and 25 that ascend or descend in accordance with the screw rotation. The pins 24 and 25 are fixed to the motor 26 which is to drive the rotary cutter.

Although a disclosure was made concerning the spiral screw 20 rotated by a motor as a means to ascend or descend the movable arm of the said hair-cutting device (Japanese Patent Application 1993-89210), it was later found that the hardness of the spiral screw 20 requires some improvement.

Although using the spiral screw 20 for the above objective is ideal from the functional and economical viewpoints, the spiral screw which rotates with the axis 24 and 25 put in, turned out to be deflected by the tension stress of the axis when it ascends to lift hairs.

This problem concerning the hardness can be solved if the spiral screw 20 is made of a thicker resin cylinder, or of a rigid deflection-free metal. Such improvement, however, makes the device harder to handle because of its heavier weight. For professional use, in particular, it is preferable that the device is made as light as possible, because the difference of its weight, even by a few grams, causes a great difference in the user's fatigue during the work. The weight of a spiral screw free of the hardness or durability problem is likely to exceed the ideal value for the work, whereas the more frequent parts replacement will be required if its weight is made light enough.

Then, the object of the present invention is to lighten the weight of the means to drive the movable arm up and down, and at the same time to improve its hardness.

SUMMARY OF THE INVENTION

To achieve the above objectives, the hair-cutting device concerning the present invention comprises: a grip; a cylindrical guide attached to the grip; a fixed arm and a movable arm protruded from the cylindrical guide; combs on each end of the said arms; teeth to nip hairs and means to cut hairs set on each of the combs; a means to drive the movable arm up and down by any desired and preset distance installed in the above cylindrical guide; a means to switch the means to drive the movable arm on the grip; and the means to drive the movable arm comprising a bar screw which is rotated by a motor, and a ring which moves up and down in accordance with the spiral groove of the bar screw, on a technical premise that the rotary cutter works interlocked with the preset virtual dead end on the guide where the movable arm automatically stops.

To eliminate the possible damage on hairs caused by the above hair-cutting device, high-frequency electricity can be alternatively used to cut hairs nipped in the comb, or minute flame jet from small holes may be also used to burn off hairs nipped between the teeth of the comb.

The hair-cutting device concerning the present invention allows easy hair-cutting at any desired length in accordance with the motion of the movable arm, because the movable arm is set at the cylindrical guide connected to the grip, and the combs to nip hairs and the rotary cutter are set at the end of the movable arm. The movable arm is ascended or descended by the means to drive the arm installed in the cylindrical guide and the means to switch on the grip. The means to switch on the grip turns the means to drive the arm in the cylindrical guide ON, which in turn makes the arm move by a distance to stop where the rotary cutter is turned ON. The rotary cutter is automatically turned OFF at a preset timing (after a preset number of seconds, or number of rotations).

Instead of the aforementioned spiral cylinder, the means to drive the movable arm comprises a bar screw that is rotated by a motor, and a ring that ascends or descends in accordance with the bar screw s spiral groove. Unlike the spiral cylinder, the only required feature of the bar screw is simply that it should be rotated, and does not need to have any spiral slit, and is not going to incur any infliction of strong external force. Therefore, hardness of the material for the bar screw is not necessarily required. Even a thin resin tube will endure repeated operations. Consequently, the invention allows a trouble-free hair-cutting device with sufficient endurance even under daily repeated operations by professional hairdressers, yet successfully satisfying the functional requirement to make the total weight of the device as light as possible.

In the above description, hairs are cut with the rotary cutter attached on the comb part which is to hold and cut hairs. In general, there will be no problem in cutting hairs by a rotary cutter. However, from the hairs' health point of view, it is preferable to cut hairs by burning them off, because of the cellular characteristics of the hairs as a part of the human body. That is to say, collagen and other proteins are what composes hairs. It is a well known fact that hairs cut by a cutter is decolorized into brown (if they are black hairs), and dried up to be split, because protein and pigment in hairs escape from the cut ends.

If hairs are burned off by high-frequency electricity or small flame jets from minute holes, collagen becomes solidified to close the hair ends, thus completely preventing nutritive substances from scattering out of the hairs. Usually a flame of a gas lighter or a match can cut tens or hundreds of hairs at once. Therefore, either high-frequency electricity heat or minute flame jets used in this invention should be extremely weak, so that the heat radiation is limited, by jetting it out of, for instance, a slender pipe, so that the hairs held by the comb are cut instantly without any danger, yet securing the health of hairs.

DESCRIPTION OF THE PREFERRED EMBODIMENT

Figure 1:
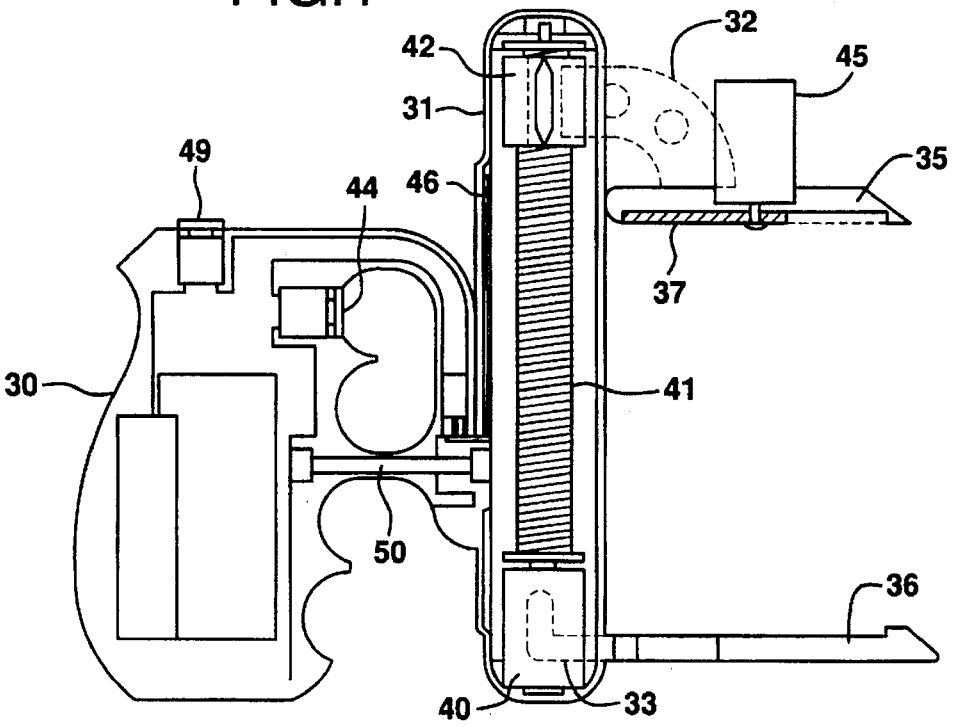
FIG. 1) An illustration showing the example of the internal constitution of the hair-cutting device concerning the present invention.
Figure 2:
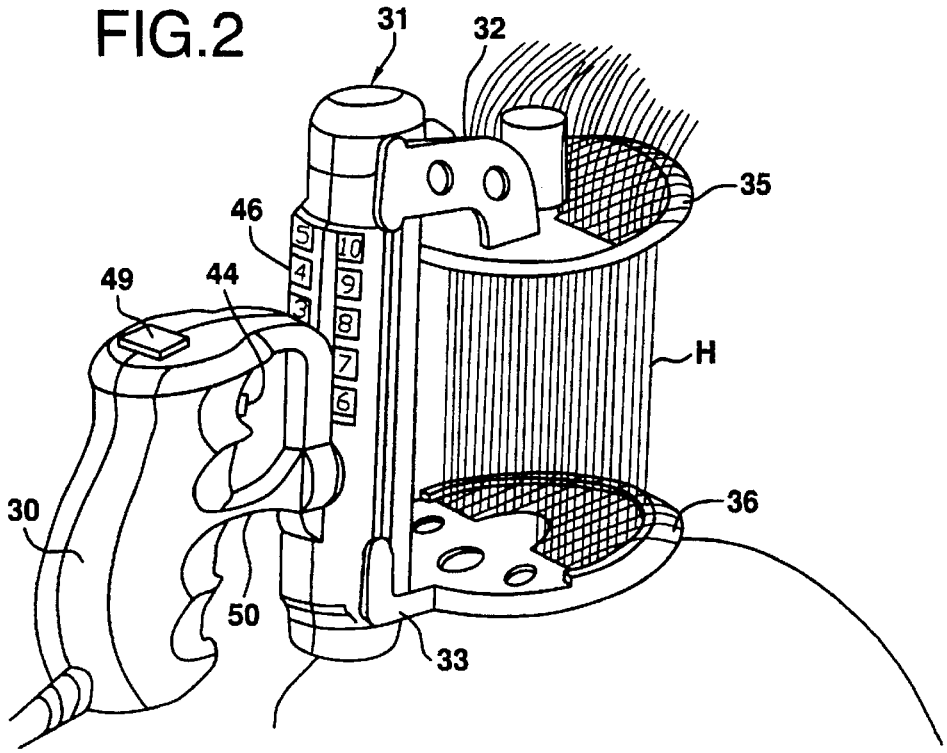
FIG. 2) An illustration showing the example of the use of the hair-cutting device concerning the present invention.

This invention will be more clearly understood with reference to the following examples with the attached drawings. The appearances of the hair-cutting device concerning the present invention should be as shown in FIG. 1 and FIG. 2, and should comprise at least a grip 30, a cylindrical guide 31 attached to the grip, a movable arm 32 and a fixed arm 33 protruded from the cylindrical guide, and combs 35 and 36 attached to each end of the arms respectively. An instrument for cutting hair, for example, a rotary cutter 37 should be set at the reverse side of the comb of the movable arm 32.

The means to drive the movable arm 32 up and down is set in the cylindrical guide 31, mechanically comprising a bar screw 41 that is rotated by a drive motor 40, and a ring 42 that ascends or descends in accordance with the spiral groove of the bar screw. The base end of the movable arm 32 should be fixed to the ring 42, so that the arm goes up and down along with the ring.

Any suitable material such as resin or metal may be used for the bar screw 41, because the only requirement for the bar screw is simply to be rotated by the drive motor 40. Furthermore, the bar screw can be formed into a hollow pipe, because the ring 42 does not inflict any heavy overload on the rotating bar screw, even while the ring is moving upward or downward in accordance with the spiral groove of the bar screw. If the bar screw 41 is formed hollow, of vinyl chloride for instance, approx. 1 mm thickness (the thickness from the groove bottom to the inner surface) is sufficient to resist the lead during operation without being deformed, and approx. 0.5 mm thickness is sufficient for such hollow bar screw if it is made of steel or aluminum. When forming the bar screw into a hollow pipe, the preferable thickness is approx. 1 mm to 3 mm, considering the difficulty of forming the shape with thin material.

The sectional diameter (the inner diameter) of the bar screw 41 should be approx. 2 cm for example, and should be sufficiently wide to support the lead inflicted on the movable arm 32 during the operation. The thicker the diameter is, the more the durability of the bar screw 41 improves. The total weight of the device, however, increases also. Therefore, the said diameter should be preferably approx. 3 cm when made of a resin and approx. 2.5 cm when made of a metal. As the motor 40 that drives the bar screw 41 to rotate, an air turbine can also be used instead of a small-sized electric motor. The switch 44 for the motor 40 should be preferably set on the grip 30 so as to allow easy operation of the hair-cutting device by a finger. The marking 49 in FIG. 1 indicates an ON-OFF switch for the device.

The material for the ring 42 can be either a resin or a metal, because its sufficient hardness is required to endure only several ten grams of lead at the maximum inflicted when combs 35 and 38 nip and lift hairs in accordance with the spiral groove of the bar screw. Consequently, the thickness of the ring 41 can be designed in accordance with the load, approx. 0.5 to 3 mm for example. The appearance of the outer surface of the ring 42 is not limited to any particular shape. It may be circular, quadrangular, pentagonal, or in any other polygonal shape. The vertical dimension of the ring 42 is, for example, approx.1 cm at the shortest, which is sufficient length to fix the lower end of the movable arm 32. Approx. 1.5 to 3 cm is preferable for the vertical dimension of the ring 42, to avoid excessive overload concentrated on the bar screw 41.

The motor 40 drives the movable arm 32 to stop at a position preset by the control switch 48 that is arranged at any suitable place such as the surface of the cylindrical guide 31. By pushing or touching a part of the said switch, a user can select any desired position where the movable arm 32 should be stopped. In the figure, the numbers on the switch indicate the position in centimeters.

To stop the movable arm 32 at a desired and selected position, the operation of the motor 40 must be controlled. This may be achieved by regulating the time of electric supply to the motor 40 or by the rotational frequency of the motor, or by monitoring the current position of the movable arm so as to stop the operation of the drive motor at the preset position, or by any other method. A timer circuit such as MPU (microprocessor unit) may be used to regulate the time for electricity supply, and an MPU or any other means to count the number of rotation to regulate the rotational frequency of the motor. Detection of the position of the movable arm is possible by a mechanical limit switch, or a magnetic or optical sensor. Any means may be incorporated as far as it is capable of stopping the movable arm 32 at the preset top end. In case of using a limit switch, the data representing the detected current position of the arm and the same representing the preset desired position should be logically compared, so that the electricity supply to the motor 40 is stopped if the two data match.

Figure 3:
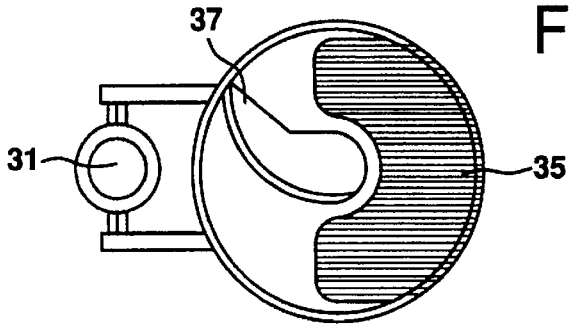
FIG. 3) An illustration showing the example of a rotary cutter concerning the present invention.
Figure 4:
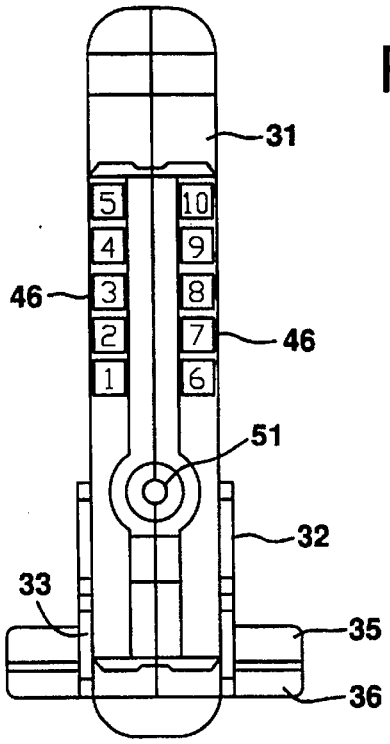
FIG. 4) An illustration showing the joint part of the cylindrical guide concerning the present invention.

The rotary cutter 37 starts to cut hairs interlocked with the movable arm 32. That is, the driver (the drive motor 45) for the rotary cutter, namely a small-sized motor or an air turbine, starts working when the movable arm 32 reaches the top end and the electric current to the drive motor 40 is cut OFF by the control switch 46. It would be ideal if the rotary cutter 37 is designed to cut a little amount of hairs per rotation in order to reduce the load inflicted on it. The edge of the rotary cutter 37 of this example is curved so as to cut a small amount of hairs per rotation as shown in FIG. 3, thus reducing the load when cutting.

The marking 50 in FIG. 1 illustrates the connector of the grip 30 and the cylindrical guide 31, in which signal wires are contained. Such signal lines may be wired through the curved void into the grip 30. The fitting part 51 of the connector 50 and the cylindrical guide 31 is formed into a circle so as that the connector 50 (the grip 30) turns at least 90 degrees clockwise or counter clockwise against the cylindrical guide 31, thus greatly improving the operational dexterity of the hair cutter.

The position to stop the movable arm 32 is set by the control switch 46 in accordance with the desired haircut length, the combs 35 and 38 nip the hairs H, the drive motor 40 rotates the bar screw 41 when the switch 44 on the grip 30 is turned ON, and the ring 42, which moves upward in accordance with the spiral groove of the bar screw 41, lifts the movable arm 32 (FIG. 2). As the movable arm 32 is lifted, the comb 35 on the edge of the movable arm 32 raises the hairs H. When the arm 32 reaches to the preset top end, the motor 40 stops and electricity is supplied to the motor 45, thus driving the rotary cutter 37 to cut hairs H. The time required for electricity supply to the motor 45 is approx. 1 to 3 seconds at the most, because hair cutting is done in an extremely short time.

As the electricity supply to the rotary cutter 37 is stopped, the motor 40 reverses, and the movable arm 32 descends to the bottom end to stop there. The above sequential action of the hair-cutting device allows haircut to any desired length preset by the control switch 46. If another haircut to exactly the same length is required, the switch 44 should be simply turned ON again.

The rotary cutter 37 attached on the back side (the lower surface) of the upper comb should be made of a hard and thin material such as metal or ceramic, because the cutter works on the principle of scissors. The combs 35 and 36 themselves, of course, can be made of a metal or a ceramic, but only their back sides may be arranged with a hard material so as to save the weight. In this case, the surface of the combs can be moralized or covered with a thin film made of a hard material. The lower comb 36 can be made of any resin of a general kind. The distance to the highest (maximum top) position of the movable arm 32 from the bottom dead end should be, for example 10 cm, which is a necessary length for cutting women's hair, although 7 cm is long enough for men's hair in general.

Figure 5:
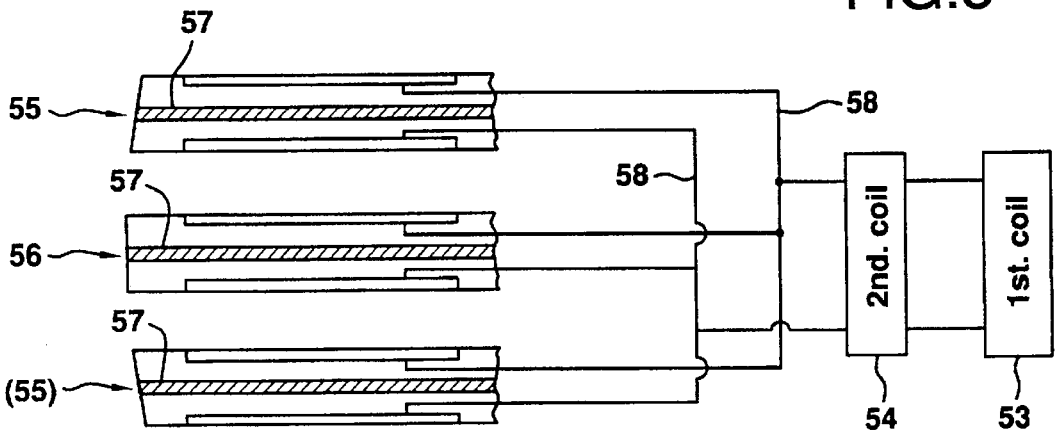
FIG. 5) An illustration showing the constructional example of the means to cut hairs (high-frequency electricity) concerning the present invention.
Figure 6:
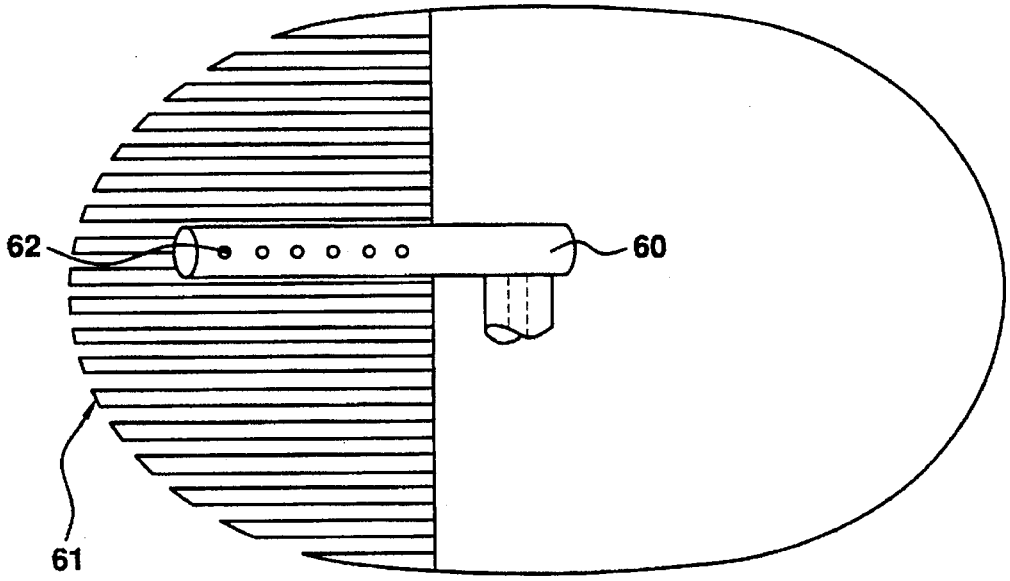
FIG. 6) An illustration showing the constructional example of the means to cut hairs (minute flame) concerning the present invention.
Figure 7:
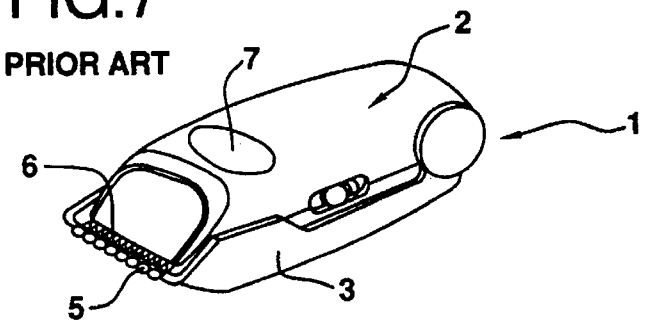
FIG.7 PRIOR ART
FIG. 7) A perspective view showing the example of conventional hair-cutting devices.
Figure 8:
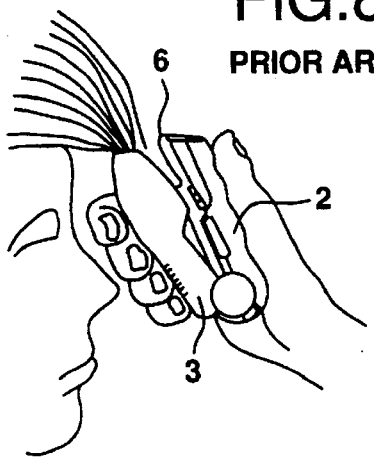
FIG.8 PRIOR ART
FIG. 8) A perspective view showing the example of the use of the conventional hair-cutting device.
Figure 9:
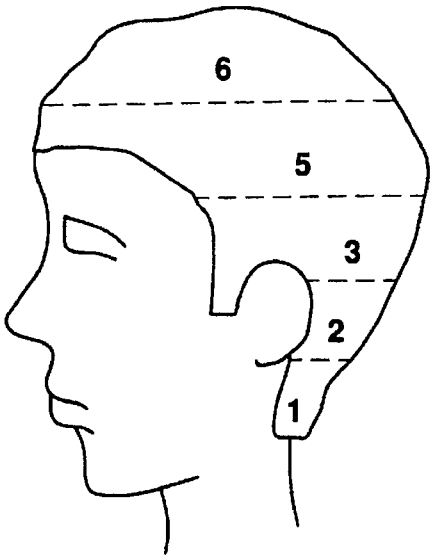
FIG.9 PRIOR ART
FIG. 9) An illustration showing an example of haircut length proportion.
Figure 10:
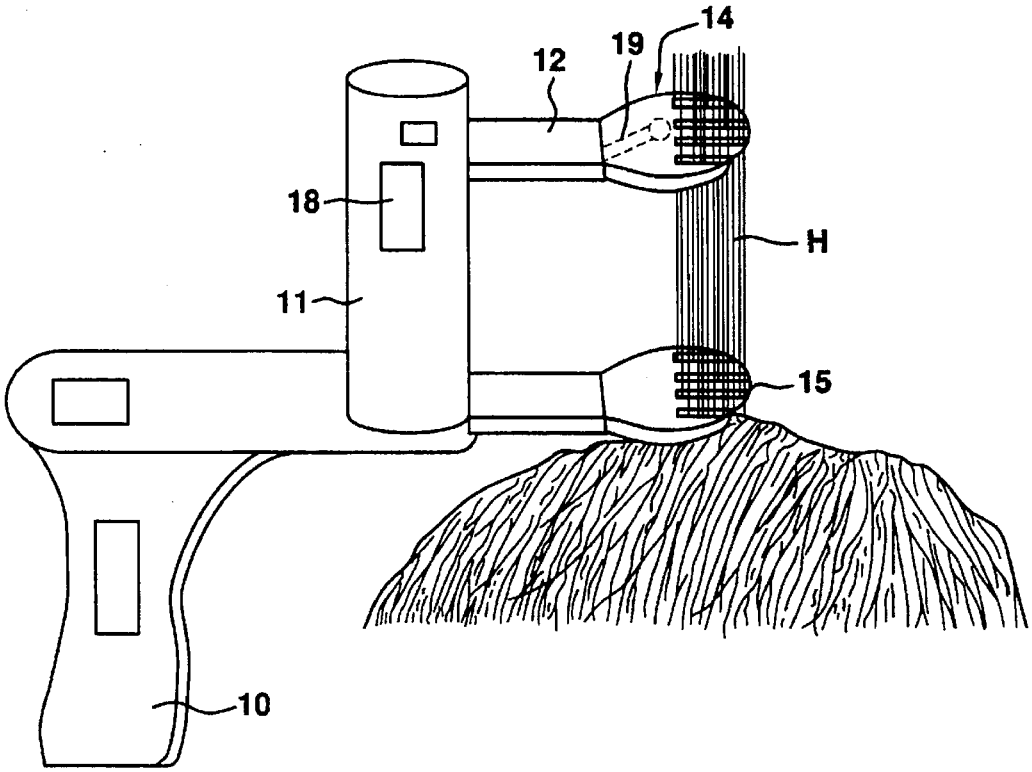
FIG.10 PRIOR ART
FIG. 10) An illustration showing an appearance example of the hair-cutting device the applicant proposes.
Figure 11:
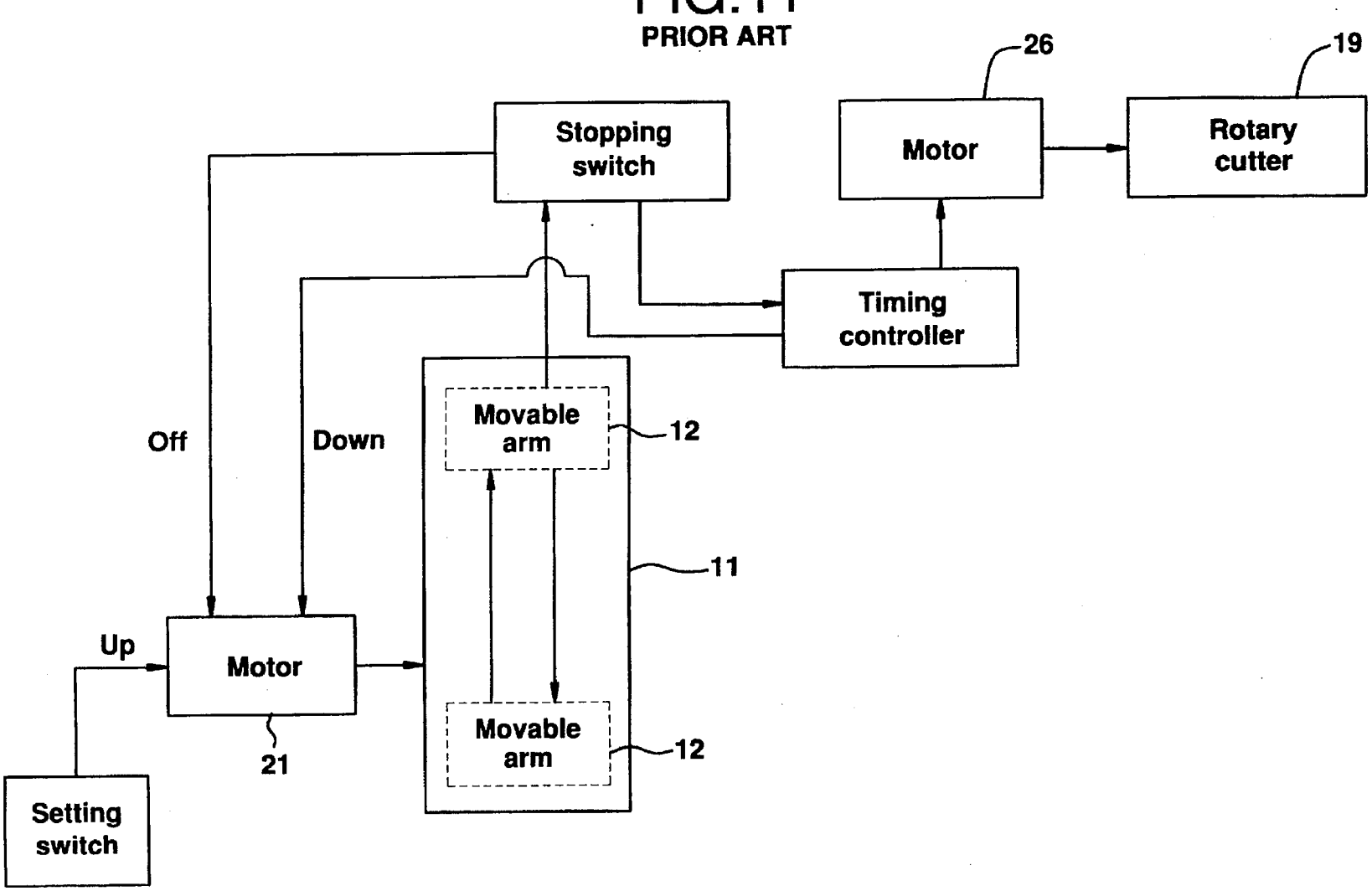
FIG.11 PRIOR ART
FIG. 11) A block diagram indicating the drive relations of the device shown in FIG. 10.
Figure 12:
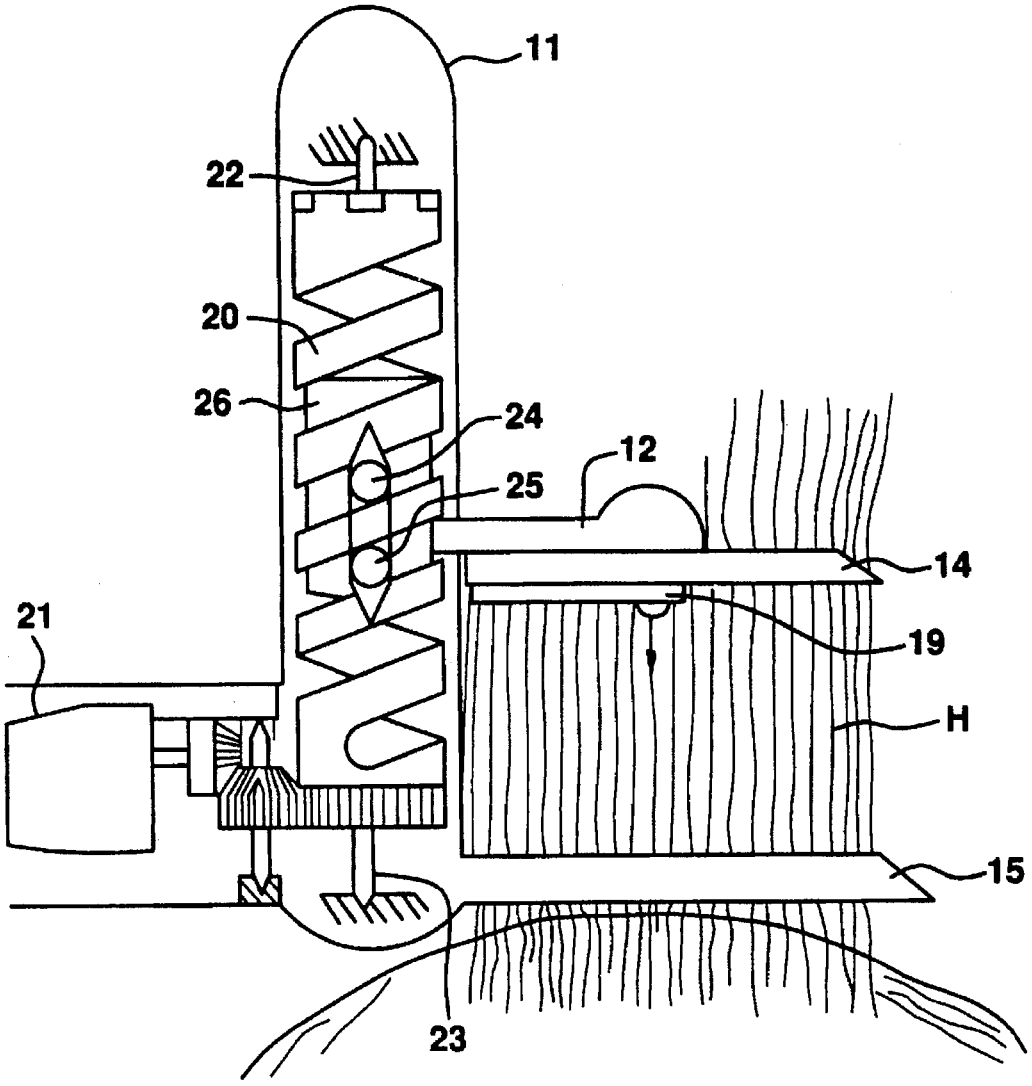
FIG.12 PRIOR ART
FIG. 12) A figure indicating the driving mechanism of the movable arm shown in FIG. 10.

The means to cut hairs nipped in the combs is not necessarily limited to a rotary cutter. Any means capable of cutting hairs at the position of the upper comb may be incorporated. For example, high-frequency electricity or minute flame is also applicable for hair cutting, because burning off with partial heating effectively keeps natural health of the hairs. To use high-frequency electricity as a means to cut hair, the primary coil and the secondary coil should be enclosed in an appropriate place such as the cylindrical guide, and positive and negative electricity lines taken from the secondary coil are led to the teeth of the comb so as to discharge high-frequency electricity at the teeth facing one another, thus fusing hair. In this case, both positive and negative electricity lines should be brought into each of the teeth. This would be possible by laying the electricity lines 58 in each of the teeth 55 and 56 of the upper comb, with an insulation 57 installed in between as shown in FIG. 5, ensuring to cut hairs nipped between the teeth facing each other. The marking 53 and 54 show the primary coil and the secondary coil, respectively.

To use a minute flame as a means to cut hair, a movable heat-resisting slender tube 60 with minute holes 62 is installed on the back side of the comb 61 of the upper moveable arm, so as to jet small flames. The said slender tube 60 should be formed from, for example, a metal pipe of 5 mm in diameter, and pierced with holes of approx. 1 mm in diameter. A suitable ignition system (e.g. gas lighter system) set in the movable arm ignites a small flame, and the flame is brought into the slender tube 60 to jet from the minute holes 62. The rotation of the slender tube may be in the same manner as that of the mentioned rotary cutter, and small nozzles may be set around the openings of the minute holes 62 so as to sharpen the flame even more. Burning the hairs off in this manner is also effective for securing the nutrition and health of the hairs.

The hair-cutting device concerning the present invention is not limited to the above examples. The rotary cutter may turn counterclockwise, and the shape of the rotary cutter could be variegated. The shape of the lower comb is also unlimited, as well as the same of the upper comb as far as a rotary cutter is not exposed. The motor to drive the rotary cutter may be set in an upper side comb as long as the motor is a sufficiently light, like a supersonic vibrating motor, whereas the motor described in the example herein is enclosed in the cylindrical guide.

The opening of the cylindrical guide, in which the movable arm ascends or descends, should be covered with a replaceable elastic material such as a rubber or urethane membrane, so as to prevent hairs from coming into the device. The shape of the grip is not limited to the gun-butt shape as shown in the example, and accordingly any shape of any of all the parts in the explanatory figures for the example is not essentially a required condition for the present invention, but simply a representation.

As described above, the hair-cutting device concerning the present invention allows lighter means to drive the movable arm UP/DOWN, yet improving the device's strength.

While the invention has been explained with reference to a specific embodiment, it is to be noted that the description is illustrative and the invention is limited only by the appended claims.

What is claimed is:

1. A hair-cutting device comprising:

a grip;

a guide attached to the grip;

a fixed arm and a movable arm protruding from the guide;

combs placed on said fixed and said movable arms, at least one of the combs having nipping and cutting means for nipping and cutting hairs;

driving means for driving the movable arm to move by a preset distance; and switching means for switching the driving means ON and OFF; wherein said driving means comprises a bar screw having a spiral groove formed thereon, a motor for rotating the bar screw, and a ring engaged with the spiral groove of the rotating bar screw to move up and down as the bar screw rotates, the ring being engaged with the movable arm to drive the movable arm.

2. A hair-cutting device described in claim 1, wherein the nipping and cutting means comprises means for applying high-frequency electricity to the hairs to cut the hairs.

3. A hair-cutting device as described in claim 1, wherein the nipping and cutting means comprises means for applying minute flames the hairs to cut the hairs.

4. A hair-cutting device as described in claim 1, wherein the nipping and cutting means comprises a rotary cutter and a second motor for rotating the rotary cutter.

5. A hair-cutting device as described in claim 1, wherein the grip comprises fitting means for attaching the guide to the grip to allow relative rotation between the grip and the guide.

6. A hair-cutting device as described in claim 1, wherein the driving means further comprises control switch means for selecting the preset distance from among a plurality of distances.

* * * * *